US008516817B2

(12) United States Patent
Fedorov et al.

(10) Patent No.: US 8,516,817 B2
(45) Date of Patent: Aug. 27, 2013

(54) ELECTROGENERATING DEVICE WITH A HIGH-TEMPERATURE STEAM TURBINE

(76) Inventors: Vladimir Alekseevich Fedorov, Kaluga (RU); Oleg Nikolaevich Favorskiy, Moscow (RU); Alexander Ivanovich Leontiev, Moscow (RU); Oleg Osherevich Milman, Kaluga (RU)

( * ) Notice: Subject to any disclaimer, the term of this patent is extended or adjusted under 35 U.S.C. 154(b) by 889 days.

(21) Appl. No.: 12/527,646

(22) PCT Filed: Oct. 10, 2007

(86) PCT No.: PCT/RU2007/000550
§ 371 (c)(1),
(2), (4) Date: Jan. 22, 2010

(87) PCT Pub. No.: WO2008/103067
PCT Pub. Date: Aug. 28, 2008

(65) Prior Publication Data

US 2010/0139275 A1 Jun. 10, 2010

(30) Foreign Application Priority Data

Feb. 19, 2007 (RU) ..... 2007106296

(51) Int. Cl.
*F01K 13/00* (2006.01)

(52) U.S. Cl.
USPC ..... 60/676; 60/653; 60/670

(58) Field of Classification Search
USPC ..... 60/649, 651, 671, 676, 653, 670
See application file for complete search history.

(56) References Cited

U.S. PATENT DOCUMENTS 5,485,728 A * 1/1996 Dickinson ..... 60/648
5,644,911 A 7/1997 Huber (Continued)

FOREIGN PATENT DOCUMENTS

RU 30848 7/2003

(Continued)

OTHER PUBLICATIONS

International Search Report, International Application No. PCT/RU2007/000550, date of the completion of the search Jan. 15, 2008, 1 page.

(Continued)

*Primary Examiner* — Hoang Nguyen
(74) *Attorney, Agent, or Firm* — Fitch, Even, Tabin & Flannery LLP

(57) ABSTRACT

An electrogenerating device comprises a steam boiler, a hydrogen plant for steam conversion of natural gas into hydrogen, an oxygen plant for production of oxygen from air, a high-temperature $H_2/O_2$ steam superheater, a steam turbine provided with an electric power generator and a condenser, and a heat recovery boiler. Inlets of the high-temperature steam superheater are connected to an outlet of the steam boiler and outlets of the hydrogen and oxygen plants at a ratio of hydrogen to oxygen flow rates close to a stoichiometric ratio. The total noncondensable gas impurities in hydrogen and oxygen are less than 0.5% by volume at a temperature of 20 to 100° C. An outlet of the high-temperature steam superheater is connected to an inlet of the steam turbine, an outlet of the hydrogen plant is exhaust-gas connected to a gas path of the heat recovery boiler. In addition, an outlet of the heat recovery boiler is steam connected to an intermediate inlet of the steam turbine. The electrogenerating device makes it possible to continuously produce electric power with high efficiency and can be used for production of electric power using a combination of organic and hydrogen fuels.

4 Claims, 1 Drawing Sheet

(56) References Cited

U.S. PATENT DOCUMENTS

| | | | | |
|---|---|---|---|---|
| 5,953,900 | A | 9/1999 | Bannister et al. | |
| 7,690,201 | B2 * | 4/2010 | Kravets | 60/653 |
| 7,882,692 | B2 * | 2/2011 | Pronske et al. | 60/39.182 |
| 2007/0204620 | A1 * | 9/2007 | Pronske et al. | 60/671 |
| 2008/0141672 | A1 * | 6/2008 | Shah et al. | 60/648 |
| 2010/0242478 | A1 * | 9/2010 | Wojak | 60/645 |

FOREIGN PATENT DOCUMENTS

| | | | |
|---|---|---|---|
| RU | 2226646 | C2 | 4/2004 |
| RU | 54 631 | U1 | 7/2006 |
| RU | 64 699 | U1 | 7/2007 |
| SU | 162162 | | 4/1964 |

OTHER PUBLICATIONS

International Preliminary Report on Patentability and Written Opinion, International Application No. PCT/RU2007/000550, issued Nov. 17, 2009, 6 pages.

* cited by examiner

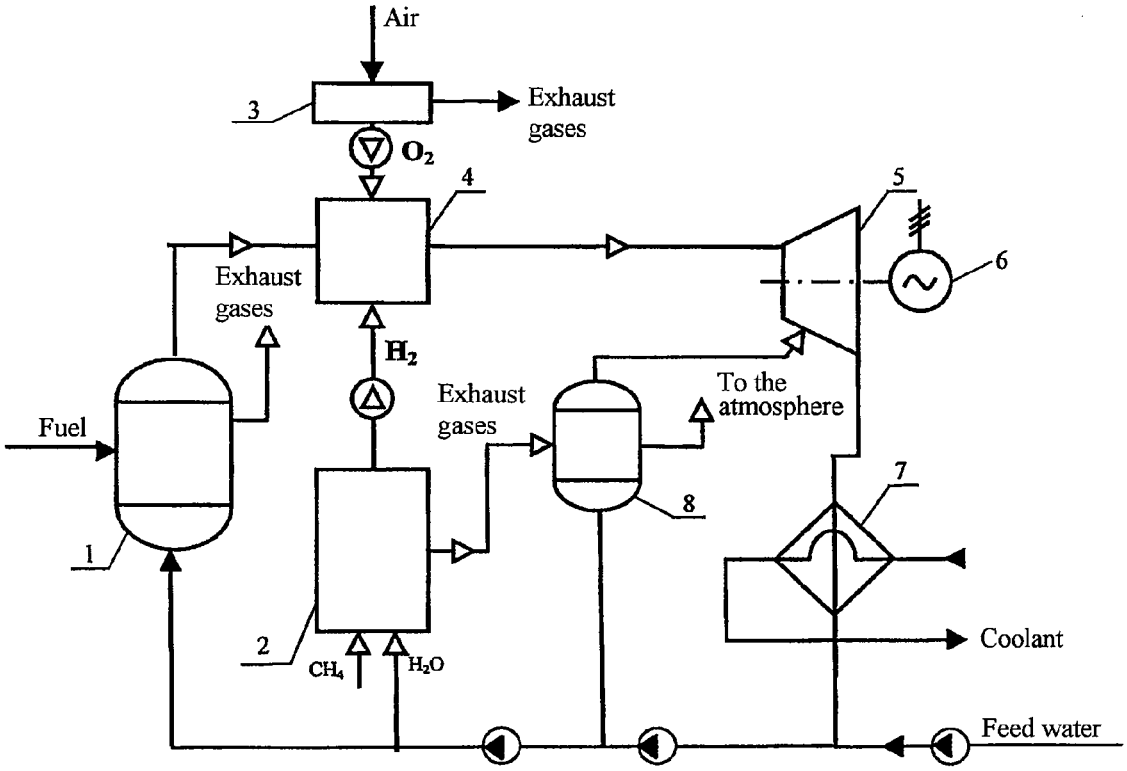
Air
3
Exhaust gases
$O_2$
4
5
6
Exhaust gases
$H_2$
Exhaust gases
To the atmosphere
Fuel
7
8
1
2
$CH_4$
$H_2O$
Coolant
Feed water

ELECTROGENERATING DEVICE WITH A HIGH-TEMPERATURE STEAM TURBINE

FIELD OF THE INVENTION

The present invention relates to power engineering and can be used for production of electric power using a combination of organic and hydrogen fuels.

BACKGROUND OF THE INVENTION

A device is known which comprises a steam boiler, $H_2/O_2$ steam generator, a steam turbine and a steam-and-gas turbine having electric power generators, a system for production of hydrogen and oxygen by electrolysis, and a system for collecting hydrogen and oxygen (Utility Model Patent No. RU 30848, Oct. 10, 2002).

The advantageous technical result of this kind of systems is achieved owing to the production of hydrogen and oxygen in an electrolytic cell during night-time dip in the electric load diagram. The electrolysis load evens the load diagram and makes it possible to produce additional power at consumption peaks.

A drawback of the device according to Patent No. 30848 is that it uses an electrolytic cell to produce $H_2$ and $O_2$, two turbines and two electric power generators, and that the hydrogen fueled steam-and-gas turbine can operate only intermittently with an interval required to collect hydrogen and oxygen in dedicated plants. The system is therefore complicated and necessarily needs a large volume storage unit for oxygen and hydrogen.

Most closely related to the present invention is a device comprising a steam boiler, a hydrogen plant for production of hydrogen by conversion from natural gas, an $H_2/O_2$ steam generator (a high-temperature $H_2/O_2$ steam superheater), a steam turbine provided with an electric power generator and a condenser, and a heat recovery boiler (Utility Model Patent No. RU 54631, Aug. 6, 2005).

The advantageous technical result is attained here owing to the supplement of a power station cycle with hydrogen plants for conversion of natural gas to hydrogen, so that large hydrogen storage units are no longer needed.

Drawbacks of this prior art document is that it is silent of a permissible amount of noncondensable gases in $H_2$ and $O_2$ admitted to the $H_2/O_2$ steam generator, and does not indicate a ratio of $H_2$ to $O_2$ flow rates. These parameters can have effect on the condenser operation and the reduction of power efficiency of the system as a whole. The prior art is silent of sources and working media for production of oxygen and for cooling the turbine flow part.

SUMMARY OF THE INVENTION

The technical result of the present invention is the increased power production efficiency and the improved process parameter stability of a steam turbine continuously operating at its rated power, owing to the increased temperature and pressure when hydrogen and oxygen are combusted in water steam atmosphere, and the reduced hydrogen transport and storage energy losses.

The technical result of the invention is achieved by a device comprising a steam boiler, a high-temperature $H_2/O_2$ steam superheater, a heat recovery boiler, a steam turbine provided with an electric power generator and a condenser, and a hydrogen plant for production of hydrogen by conversion from natural gas, wherein said device further comprises an oxygen plant for production of oxygen by air separation, and the total noncondensable gas impurities in hydrogen and oxygen are less than 0.5% by volume at a temperature of 20 to 100° C., wherein inlets of the high-temperature steam superheater are connected to an outlet of the steam boiler and to outlets of the hydrogen and oxygen plants at a ratio of hydrogen to oxygen flow rates close to a stoichiometric ratio (about ±1%) to provide complete combustion thereof in water steam atmosphere without an intermediate heat exchange surface, and an outlet of the high-temperature steam superheater is connected to an inlet of the steam turbine, wherein an outlet of the hydrogen plant is exhaust-gas connected to a gas path of the heat recovery boiler, and an outlet of the heat recovery boiler is steam connected to an intermediate inlet of the steam turbine and/or to a cooling system of the steam turbine flow part.

The supplement of a power station with a hydrogen plant for production of hydrogen by conversion from natural gas and an oxygen plant for production of oxygen by air-separation makes it possible to provide continuous operation of the steam turbine at its rated power at high initial temperature and pressure. A high temperature (up to 2000K) of water steam at the steam turbine inlet achieved by combustion of oxygen and hydrogen in water steam atmosphere in the high-temperature $H_2/O_2$ steam superheater without an intermediate heat exchange surface after the water steam exits the steam boiler provides operation conditions of the steam turbine that are typical to gas turbines, while the steam turbine outlet is connected to a steam consenser providing a negative pressure. The power production efficiency can be improved by increasing the initial temperature and reducing the turbine exit temperature, and by reducing the steam humidity.

It should be noted that heating of water steam above 900 K is substantially prohibited in currently used steam boilers due to tube burning irrespective of the fuel type (natural gas, hydrogen, coil, etc.).

BRIEF DESCRIPTION OF THE DRAWING

The attached drawing shows a schematic diagram of an inventive device. Referring to the drawing, a device comprises a steam boiler 1, a hydrogen plant 2 for production of hydrogen by steam conversion from natural gas, an oxygen plant 3 for production of oxygen by air separation, a high-temperature $H_2/O_2$ steam superheater 4, a steam turbine 5 provided with an electric power generator 6 and a condenser 7, and a heat recovery boiler 8.

DESCRIPTION OF PREFERRED EMBODIMENT

The device operates as follows: steam is supplied from a steam boiler 1 into a high-temperature $H_2/O_2$ steam superheater 4. In the high-temperature $H_2/O_2$ steam superheater 4, the steam is superheated by admission and combustion of hydrogen and oxygen in water steam atmosphere without an intermediate heat exchange surface. To utilize energy of an exhaust gas from the hydrogen plant, a heat recovery boiler 8 is provided having an outlet that is connected to an intermediate steam inlet in the turbine 5 having an electric power generator 6, and (or) to a cooling system of the flow part of the turbine.

The increasing of the steam temperature upstream of the turbine 5 improves efficiency of the power plant owing to both the increased thermal efficiency and the reduced humidity downstream of the last turbine stage. Admission of additional amount of steam from the heat recovery boiler 8 into the turbine 5 increases both the power and the efficiency of the system as a whole. The exhaust steam from the turbine is directed to a condenser 7 where it returns its heat to cooling water. The resulting condensate is pumped out to the steam boiler 1 and the heat recovery boiler 8. A low absolute pressure is maintained in the condenser, increasing thereby the heat drop and plant power.

INDUSTRIAL APPLICABILITY

The invented electrogenerating device combines the ability of operation at a high initial steam temperature typical to gas turbines and at a high initial and low final pressure typical to steam turbines. The use of hydrogen plant for production of hydrogen by conversion from natural gas and an oxygen plant for production of oxygen by air separation in the system eliminates the need for large volume storage units for explosive and flammable gases, reduces transport and storage losses, and enables flexible control of oxygen and hydrogen flow rates; this, on one hand, increases the fuel utilization ratio and, on the other hand, reduces the rate of noncondensable gases in the vacuum part of the steam turbine plant. The latter fact assists in vacuum deepening, hence, increases power at given efficiency of the air remover.

The aforementioned features of the device enhance efficiency of power production as compared to the conventional steam and gas turbine plants. An advantage of the device is that coal, reduced crude, alternative fuels and renewable energy sources can be used to produce steam and provide its initial superheating. The addition of a natural gas to hydrogen conversion plant eliminates hydrogen transport and storage losses, precludes explosion of a great quantity of hydrogen, and provides continuous operation of the device at its rated efficiency.

What is claimed is:

1. An electrogenerating device with a high-temperature steam turbine for continuous electric power production, comprising:

a steam boiler;

a steam turbine provided with an electric power generator and a condenser;

a high-temperature H2/O2 steam superheater;

a heat recovery boiler;

a hydrogen plant for production of hydrogen by conversion of natural gas, and an oxygen plant for production of oxygen by air separation, wherein total noncondensable gas impurities in hydrogen and oxygen are less than 0.5% by volume at a temperature of 20 to 100° C.

2. The electrogenerating device of claim 1 wherein inlets of the high-temperature steam superheater are connected to an outlet of the steam boiler and to outlets of the hydrogen and oxygen plants with hydrogen to oxygen flow being at stoichiometric rates.

3. The electrogenerating device of claim 1, wherein an outlet of the high-temperature steam superheater is connected to an inlet of the steam turbine and an outlet of the hydrogen plant is exhaust-gas connected to a gas path of the heat recovery boiler.

4. The electrogenerating device of claim 1, wherein an outlet of the heat recovery boiler is steam connected to an intermediate inlet of the steam turbine and to a cooling system of a flow part of the steam turbine.

* * * * *